United States Patent [19]

Siden

[11] Patent Number: 4,977,709

[45] Date of Patent: Dec. 18, 1990

[54] ABRASIVE WHEEL

[75] Inventor: Jan Siden, Skelleftea, Sweden

[73] Assignee: Inovac AB, Skelleftea, Sweden

[21] Appl. No.: 354,414

[22] Filed: May 19, 1989

[51] Int. Cl.[5] ..... B24D 5/00

[52] U.S. Cl. ..... 51/206 R; 51/206 NF

[58] Field of Search ..... 51/206 NF, 206 R, 373, 51/127, 105 EC, 105 R, 34 R, 34 C, 34 H, 50 R; 76/52, 108 A

[56] References Cited

U.S. PATENT DOCUMENTS

| | | | |
|---|---|---|---|
| 2,268,599 | 1/1942 | Kinney et al. | 51/206 R |
| 2,766,565 | 10/1956 | Robison et al. | 51/206 R |
| 3,295,188 | 1/1967 | Saueressig | 51/373 |
| 3,830,020 | 8/1974 | Gomi | 51/206 R |
| 4,457,113 | 7/1984 | Miller | 51/206 NF |
| 4,535,566 | 8/1985 | Soper et al. | 51/127 |
| 4,611,438 | 7/1986 | Siden | 51/206 R |

*Primary Examiner*—Frederick R. Schmidt
*Assistant Examiner*—M. Rachoba
*Attorney, Agent, or Firm*—Cushman, Darby & Cushman

[57] ABSTRACT

An abrasive wheel for grinding the cutting pins of a button-type drilling bit in a grinding machine of the kind provided with a rotatable holder for fixating the pins of the bit in a grinding position and for rotating thus fixated pins. The machine also includes a spindle on which the abrasive wheel can be mounted in a given position. The spindle/holder is linearly movable in a plane which extends through and is contained by the respective rotational axes of the holder and the spindle and in a direction parallel with the rotational axis of the spindle. The abrasive wheel includes circular flange parts which embrace a profiled groove therebetween. To enable cutting pins to be ground to an obtuse tip-profiled shape with the aid of such an abrasive wheel, the profiled groove, when seen in cross-section, is formed symmetrically around a line which intersects the rotational axis of the abrasive wheel at an angle whose complementary angle is equal to the angle of inclination of the spindle. The inward part of the profiled groove is widened symmetrically in relation to a predetermined transverse measurement and presents at least the same widening along the whole of it cross-section, upto the location of an outer limiting line, where the groove has a width or a breadth which is greater than the diameter of the pin for which the abrasive wheel is intended.

2 Claims, 3 Drawing Sheets

ABRASIVE WHEEL

BACKGROUND OF THE INVENTION

The present invention relates to an abrasive wheel for grinding the cutting pins or buttons, for example hard metal pins, of a button bit, to an obtuse tip-profile shape in a grinding machine. The grinding machine is preferably of the kind which is provided with a rotatable holder or fixture operative in fixating and setting the drilling-bit pins to be ground in a grinding position, and also in rotating the pin in its adjusted grinding position during a grinding process. Such a machine is further provided with a driven spindle which is intended to carry and hold the abrasive wheel in a given position. The spindle is inclined at an acute angle to a plane which extends perpendicularly through the rotational axis of the holder. The spindle and/or the holder is movable linearly in a plane which extends through and is contained by both the rotational axis of the holder and the rotational axis of the spindle and in a direction parallel with the rotational axis of the holder. The abrasive wheel includes two circular flange parts and a profiled groove extending circumferentially therebetween.

Grinding machines of the aforesaid kind are known to the art, as are also the grinding tools associated with such machines, these tools having the form of abrasive wheels used to grind pins or buttons of button-type drilling bits. The grinding wheels used in such grinding machines include two circular flange parts and a profiled groove which extends circumferentially between said flange parts. The flange parts and the profiled groove located therebetween are formed in one single abrasive wheel body which is coated with an abrasive composition adapted to the hardmetal from which the cutting pins are made. Furthermore, it is known to use in connection with such grinding machines a grinding tool which, in addition to an abrasive wheel coated with a hard metal adapted abrasive composition, also includes a further abrasive wheel or grinding body. The latter element is rotationally rigid and concentrically connected to one of the flange parts of the wheel or the body defining the profiled groove. The further wheel or body presents, at a greater radial distance from the end of the rotational axis of the abrasive wheel than the one flange part of the adjacent abrasive wheel an outer profile which extends around the end part. The further wheel or body has a substantially arcuate cross-section and extends in over the adjacent flange part. The outer profile is coated with an abrasive substance adapted to the material from which the button or pin head of the drilling bit is made.

These known abrasive wheels are configured for grinding the hard metal cutting pins of button bits, such pins having a hemispherical tip part, and are provided with profiled grooves which correspond to the shape of the pins and are thus semi-circular in cross-section, with a radius corresponding to the radius of the cutting tip of the pin.

The hard metal cutting pins of a button-type drilling bit may also have a more pointed tip profile than the hemispherical pins or buttons. This more pointed type of pin is intended primarily for use when drilling rock structures of a less compact nature, where such pins will enable the drill to penetrate the rock more efficiently than conventional pins or buttons of hemispherical configuration. These more pointed pins, however, have been found to be much more difficult to grind than pins which have a hemispherical tip profile, due to machine tolerances, the springiness of the spindle, e.g. feathering, and also to difficulties encountered in adjusting the pins to be ground to a grinding position which is centered precisely, or absolutely, in relation to the rotational axis of the holder. All of these factors combine in a disadvantageous manner, such that pointed pins ground in accordance with known techniques obtain a much more pointed tip profile than that intended.

SUMMARY OF THE INVENTION

Consequently, the object of the present invention is to provide and abrasive wheel for a grinding machine of the aforesaid kind which will enable the cutting pins or buttons of a button-type drilling bit to be ground to the intended, pointed tip profile.

BRIEF DESCRIPTION OF THE DRAWINGS

The invention will now be described with reference to the accompanying drawings, in which.

DETAILED DESCRIPTION

Figure 1:
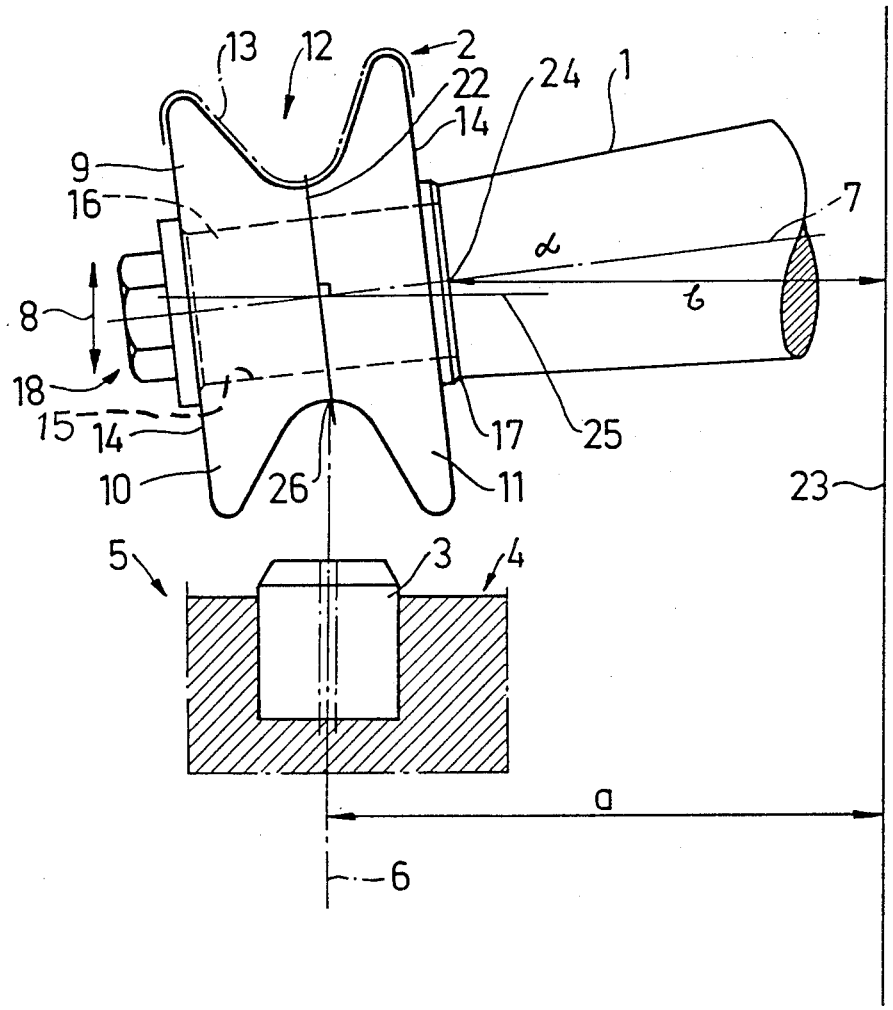
FIG. 1 is a side view, partly in section, of a worn-down pin of a button-type drilling bit adjusted to a grinding position, this pin having been ground with the aid of an abrasive wheel embodying principles of the present invention and mounted on a spindle incorporated in the grinding machine.
Figure 5:
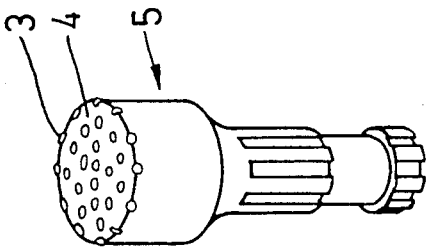
FIG. 5 illustrates a button-type drilling bit.

The reference numeral 1 in the accompanying drawings identifies a rotatably driven spindle which carries an abrasive wheel 2 constructed in accordance with the present invention. The spindle 1 is embodied in a grinding machine which is of a known kind and which will not therefore be described in detail here. The abrasive wheel 2 is intended for grinding the hard metal cutting pins 3 of a button-type drilling bit, these pins being attached to the end surface 4 of a drilling bit 5, as illustrated in FIG. 1 and also, to some extent, in FIG. 5. These Figures illustrate, by way of example, only one of a large number of known configurations of button-type drilling bits. The drilling bit 5 illustrated in FIG. 1, the cutting pins 2 of which are to be ground, is held firmly in a rotatable holder mounted in the grinding machine. The holder is represented in the drawings solely by its rotational axis 6, and the holder functions as a fixture by means of which the pins to be ground can be adjusted to and held firmly in their intended grinding positions. The rotational axis 6 of the holder mounted in the grinding machine is located in a longitudinally extending plane through the rotational axis 7 of the spindle. For the purpose of providing the requisite feed movement during a grinding process, the spindle 1 and/or the holder of the grinding machine can be displaced in such longitudinally extending plane in a direction parallel with the rotational axis 6 of the holder, as indicated by the double-headed arrow 8 in FIG. 1.

The abrasive wheel 2 includes a wheel body in the form of a steel member 9 provided with circular flange parts 10 and 11, the purpose of which is to remove the material from around the pin, and a profiled groove 12 which is formed between the flange parts. The profiled groove 12 has provided circumferentially therearound a diamond coating intended for grinding hard metal. The diamond coating is indicated in FIG. 1 by a chain line 13. In the case of the illustrated embodiments of the abrasive wheel the diamond coating has, in cross-section, an extension which is indicated by the line 13, i.e. the coating extends radially inwards to some extent along the outer surfaces 14 of respective flange parts 10 and 11. The abrasive wheel 2 also includes a through-passing hole 15 by means of which the abrasive wheel is mounted onto the journal end 16 of the spindle. The journal end has a smaller diameter than the remaining spindle diameter. The junction between the journal end 16 and the spindle 1 forms a bearing surface 17 which extends at a right angle to the rotational axis 7 of the spindle. Against this bearing surface, the abrasive wheel 2 is held firmly pressed by an attachment means 18, for instance in the form of a washer-provided bolt screwed into the journal 16. This bolt has an end surface 19 (FIG. 2) which acts as a support surface. This support or end surface 19 is provided on an abutment or shoulder 20 which projects from one side of the abrasive wheel and forms a right angle with the longitudinal axis 21 of the wheel. This axis 21 coincides with the rotational axis 7 of the spindle when the abrasive wheel is mounted in position on the spindle 1. As will be understood from the following portion of the description, the position of the support surface 19 is contingent on the width of the abrasive wheel between the outer surfaces 14 and, in the case of abrasive wheels intended for grinding coarser pins, will lie inwardly of the outer surface 14 of the flange part 11.

The profile groove 12 of the abrasive wheel is configured with a starting point from a right angle through the rotational plane 22 of the wheel extending through the rotational axis 21 of said wheel. The rotational plane 22 is parallel with the support surface 19 of the abrasive wheel and is located at a distance from said surface 19 equal to the difference between the perpendicular distance a from the rotational axis 6 of the holder to the schematically illustrated guides 23 located on the spindle and extending parallel with the axis 6, to the point 24 at which the rotational axis 7 of the spindle intersects the abrasive-wheel supporting surface 17 on the spindle 1.

When the grinding machine is correctly set-up, the abrasive wheel 2 is mounted in the manner intended on the machine spindle 1. The spindle is inclined at an acute angle $\alpha$ to a perpendicular plane 25 through the rotational axis 6 of the holder such that its extension will intersect the rotary plane 22 of the wheel at a point 26, hereinafter referred to as the rotational point. The point 26, in an associated cross-section, denotes the position of the centre of the groove bottom. In cross-section, the profile groove 12 is configured symmetrically about a line 27 which extends through the rotational point 26 and which intersects the rotational axis 21 of the abrasive wheel at an acute angle. The complement angle of this acute angle is the same as the angle of inclination $\alpha$ of the machine spindle on which the abrasive wheel 2 is mounted. The line 27, in the intended working position of the abrasive wheel on the spindle, constitutes the aforesaid geometric extension of the whole rotational axis 6 of the holder. The diameters of respective flange parts are also adapted to this angle of inclination, so that the parts of respective flange parts 10 and 11 which face towards the drill bit will lie in one and the same plane parallel with the plane 25. Furthermore, these flange parts will preferably have the smallest possible diameter, such as to provide free passage between the cutting pins 2 of the drill bit.

Figure 3:
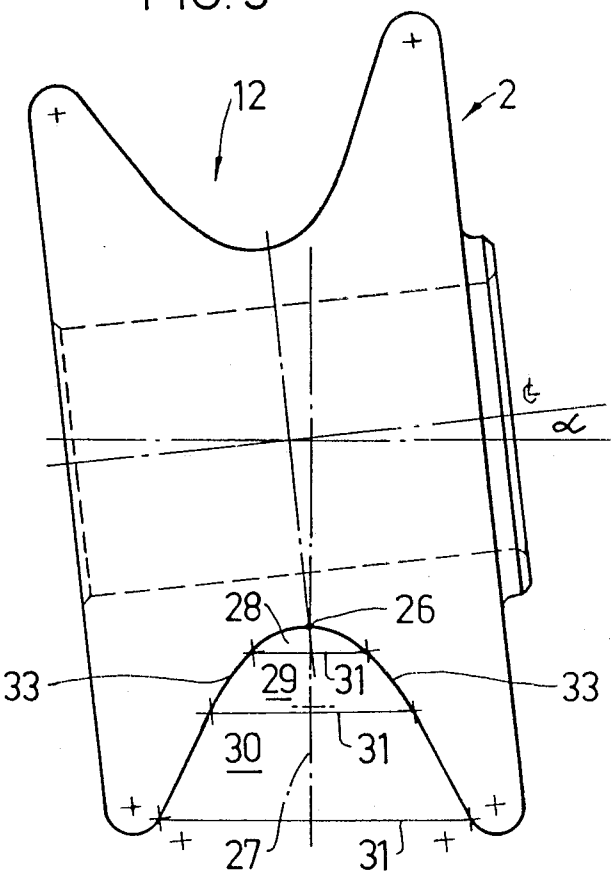
FIGS. 2 and 3 each show sectional views of the abrasive wheel of FIG. 1 in larger scale.
Figure 2:
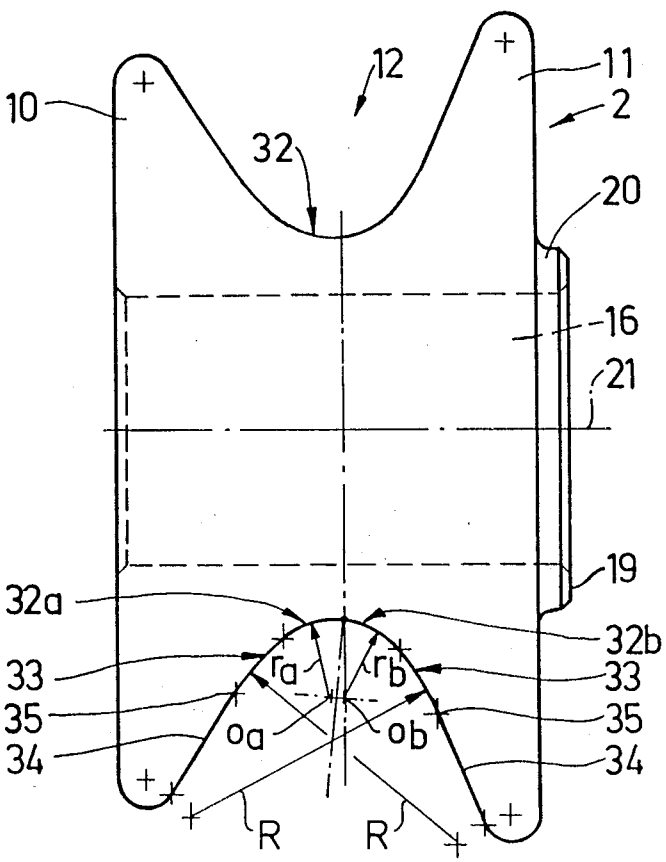

When seen from the rotational point 26, and also in cross-section, the profiled groove of the embodiment illustrated in FIGS. 2 and 3 is composed of three geometrical zones 28, 29 and 30 having mutually parallel bases 31 which form right angles with the symmetry line 27. The inner zone 28 has, in principle, the form of a circle segment the arcuate line 32 of which, forming the groove bottom, is composed of two parts **32*a*, 32*b*, each having a respective radius of curvature $r_a$, $r_b$. These radii $r_a$, $r_b$ are of mutually equal lengths but have respective centres $o_a$, $o_b$ displaced equally on a respective side of the groove symmetry line in a manner to obtain a widened groove width up to the base line 31 of the circle segment. This base line 31 also forms the upper limitation of the following zone 29 of the profiled groove. This zone has the form of a cross-section through a spherical zone or a "a trapezoid like configuration" with similar convex sides 33, the radii R of which are adapted to the radii $r_a$, $r_b$ of the circle segment, such as to obtain a continuous transition between the two zones 28 and 29. The outer zone 30 of the profiled groove has a trapezoidal shape, the opposing sides 34 of which extend tangentially from the end points 35 of the centre zone to an extent such that the base 31 of the outer zone 30 obtains a width which is greater than the diameter of the cutting pin for which the abrasive wheel is intended, and such that the outer zone 30 will present, at a distance from its base line 31** which is less than the height of the trapezoid, a width which is equal to the diameter of said pin. This embodiment of the profiled groove of the abrasive wheel is intended for grinding the hard metal pins of the drill bit to a so-called ballistic tip configuration.

The widening of the profiled groove obtained by using two radii of equal length with similarly displaced centres in relation to the symmetry line 27 of the groove provides the effect, significant in the present context, whereby compensation is obtained automatically for any errors in the positional setting of the cutting pin and in the mutual movements between the various components of the grinding machine as a result of machine tolerances and of feathering of the spindle during a grinding process.

Figure 4:
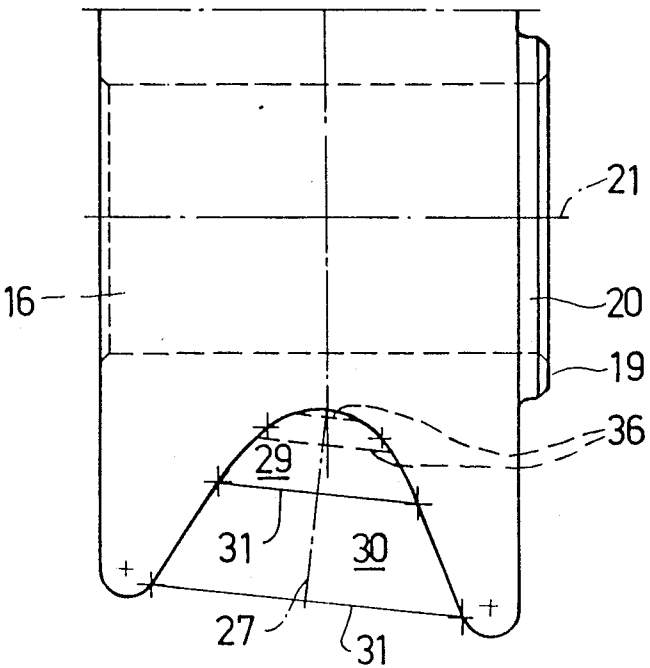
FIG. 4 illustrates alternative groove profile configurations.

The profiled groove 12 illustrated in FIGS. 1–3 has a rounded bottom 32 when seen in cross-section, although the bottom of this groove, when seen in cross-section, may also be flat, as illustrated by the broken line 36 in FIG. 4, and the centre zone 29 may alternatively have a trapezoid like configuration in as also shown in FIG. 4. In other words, a large number of profiled groove configurations are conceivable within the scope of the present invention, which is thus not restricted to the illustrated and described embodiments.

I claim:

1. An abrasive wheel for grinding a tip of a hard metal pin of a button-studded drilling bit, to an obtusely profiled shape in an annular tapered band having an axially outer, smaller diameter and an axially inner, larger diameter, in a grinding machine having:

a rotatable holder in which the hard metal pin is disposed at a grinding position and rotated about a holder rotational axis for rotating the hard metal pin while the tip of the hard metal pin is being ground by an abrasive wheel; and a driven spindle on which, in use, the abrasive wheel is disposed at a grinding position and rotated about a spindle rotational axis for rotating the abrasive wheel while the tip of the hard metal pin is being ground by the abrasive wheel;

at least one of the holder and spindle being linearly reversibly movable along said spindle rotational axis, in a plane containing both said rotational axes;

the spindle rotational axis being inclined from perpendicularity to the holder rotational axis, by an acute angle $\alpha$;

said abrasive wheel comprising:

a body which is rotationally symmetrical about an abrasive wheel rotational axis which, in use, coincides with said spindle rotational axis, said body including two circumferentially extending, radially outwardly projecting flange portions which sandwich between them a circumferentially extending, radially outwardly opening groove portion;

said groove portion having a surface profile which, in longitudinal cross-section of said abrasive wheel, is symmetrical about a line of symmetry which intersects said abrasive wheel rotational axis at an angle which is equal in magnitude to said angle $\alpha$;

said surface profile including a radially innermost base segment, two axially opposite radially outer segments having respective radially outer ends, and two axially opposite intermediate segments extending between axially opposite ends of said base segment and respective ones of said radially outer segments; said surface profile being radially outwardly generally concave and flaring in width from said axially opposite ends of said base segment towards said radially outer ends of said radially outer segments; said base segment being shorter transversally of said line of symmetry than the magnitude of said axially outer, smaller diameter of said obtusely profiled shape of said hard metal pin, and said two radially outer ends of said radially outer segments of said surface profile being located further apart transversally of said line of symmetry, than the magnitude of said axially inner, larger diameter of said obtusely profile shape of said hard metal pin.

2. A grinding machine for grinding a tip of a hard metal pin of a button-studded drilling bit, to an obtusely profiled shape in an annular tapered band having an axially outer, smaller diameter and an axially inner, larger diameter, comprising:

a rotatable holder in which the hard metal pin is disposed at a grinding position and rotated about a holder rotational axis for rotating the hard metal pin while the tip of the hard metal pin is being ground by an abrasive wheel;

an abrasive wheel; and a driven spindle on which, in use, the abrasive wheel is disposed at a grinding position and rotated about a spindle rotational axis for rotating the abrasive wheel while the tip of the hard metal pin is being ground by the abrasive wheel;

at least one of the holder and spindle being linearly reversibly movable along said spindle rotational axis, in a plane containing both said rotational axes;

the spindle rotational axis being inclined from perpendicularity to the holder rotational axis, by an acute angle $\alpha$;

said abrasive wheel comprising:

a body which is rotationally symmetrical about an abrasive wheel rotational axis which, in use, coincides with said spindle rotational axis, said body including two circumferentially extending, radially outwardly projecting flange portions which sandwich between them a circumferentially extending, radially outwardly opening groove portion;

said groove portion having a surface profile which, in longitudinal cross-section of said abrasive wheel, is symmetrical about a line of symmetry which intersects said abrasive wheel rotational axis at an angle which is equal in magnitude to said angle $\alpha$;

said surface profile including a radially innermost base segment two axially opposite radially outer segments having respective radially outer ends, and two axially opposite intermediate segments extending between axially opposite ends of said base segment and respective ones of said radially outer segments; said surface profile being radially outwardly generally concave and flaring in width from said axially opposite ends of said base segment towards said radially outer ends of said radially outer segments; said base segment being shorter transversally of said line of symmetry than the magnitude of said axially outer, smaller diameter of said obtusely profiled shape of said hard metal pin, and said two radially outer ends of said radially outer segments of said surface profile being located further apart transversally of said line of symmetry, than the magnitude of said axially inner, larger diameter of said obtusely profiled shape of said hard metal pin.

* * * * *